United States Patent [19]

Croul

[11] 4,339,122

[45] Jul. 13, 1982

[54] SURFING SLIDE

[76] Inventor: Richard D. Croul, 427 Fernleaf, Corona Del Mar, Calif. 92625

[21] Appl. No.: 148,991

[22] Filed: May 12, 1980

[51] Int. Cl.[3] ..... A63G 21/18

[52] U.S. Cl. ..... 272/56.5 R; 104/70

[58] Field of Search ..... 272/56.5 R, 56.5 SS, 272/1 R, 3, 1 B, 97, 109; 104/53, 58, 59, 69, 70, 72, 73, 86, 134; 9/310 R, 310 B, 310 E, 310 F, 310 G; 165/56, 57, 139; 5/421, 422, 423, 461, 468, 469, 473, 417; 180/125

[56] References Cited

U.S. PATENT DOCUMENTS

| | | | |
|---|---|---|---|
| 695,444 | 3/1902 | Carson et al. | 104/70 |
| 1,441,126 | 1/1923 | Sherman et al. | 104/70 |
| 1,829,287 | 10/1931 | Lovett | 401/204 |
| 2,174,716 | 10/1939 | Bethell | 272/56.5 R |
| 2,254,482 | 9/1941 | Heller | 272/56.5 R |
| 2,742,288 | 4/1956 | Brunel | 272/56.5 R |
| 2,904,809 | 9/1959 | Clayson | 401/203 X |
| 2,918,183 | 12/1959 | Petersen et al. | 180/125 MM |
| 2,982,547 | 5/1961 | Carrier | 272/56.5 R |
| 3,406,617 | 10/1968 | Randazzo | 272/56.5 SS |
| 3,497,211 | 2/1970 | Nagin | 272/56.5 SS |
| 3,547,749 | 12/1970 | White et al. | 272/56.5 SS X |
| 3,690,265 | 9/1972 | Horibata | 104/70 |
| 3,942,202 | 3/1976 | Chevrolet | 5/469 X |
| 3,981,546 | 9/1976 | Sperman | 180/125 X |
| 4,078,792 | 3/1978 | Arato | 5/461 X |

FOREIGN PATENT DOCUMENTS

| | | | |
|---|---|---|---|
| 974821 | 9/1975 | Canada | 9/310 B |
| 15140 | of 1906 | United Kingdom | 104/59 |

OTHER PUBLICATIONS

Slip'n Slide Magic Water Slide, Wham-O Mfg. Co. 1965.

*Primary Examiner*—Richard J. Apley
*Assistant Examiner*—Arnold W. Kramer

[57] ABSTRACT

An amusement apparatus is disclosed which simulates the riding experience encountered in ocean surfing, composed generally of a shaped slope having plural, stationary wave forms and multiple surface irregularities, covered with a plurality of interconnected vinyl-coated foam sections, and including an irrigation system to distribute a thin film of water over the upper-surface of the apparatus. The interconnected prefabricated sections yield an inclined planing surface which is adapted to slightly deform in response to shifting body weight of a user thereby permitting a user to turn and maneuver during travel down the apparatus on a surfboard-like vehicle.

18 Claims, 10 Drawing Figures

Fig. 4
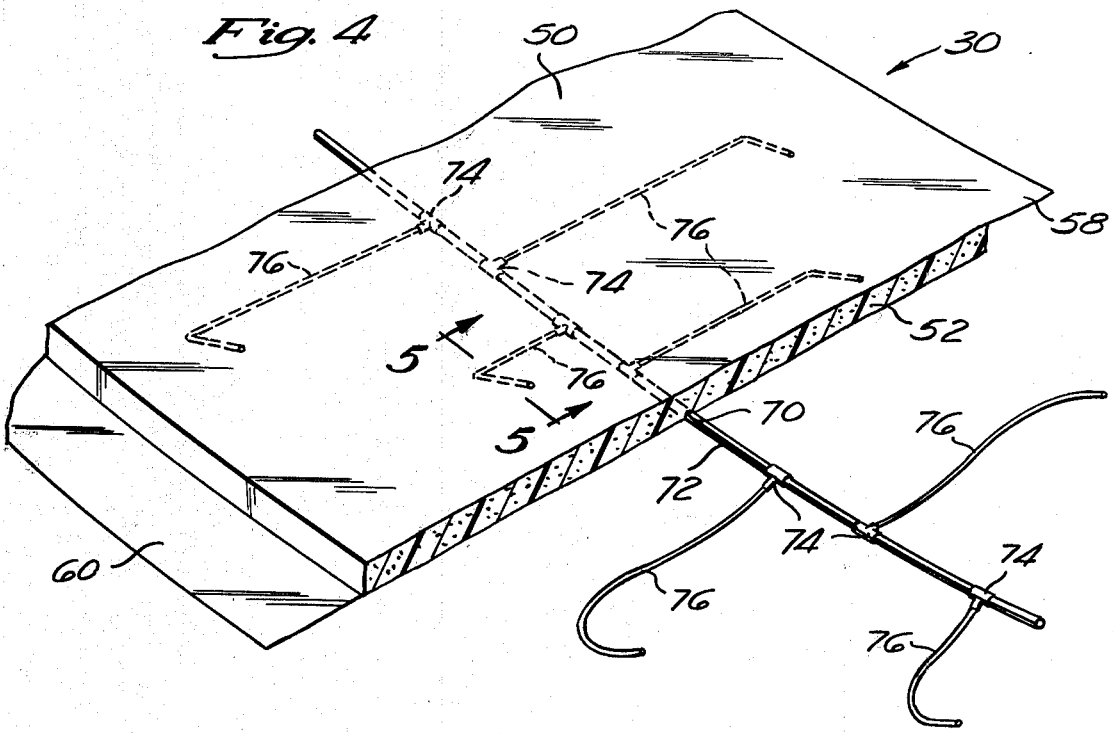
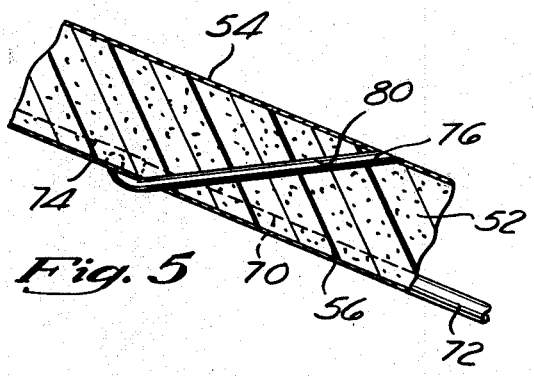
Fig. 5
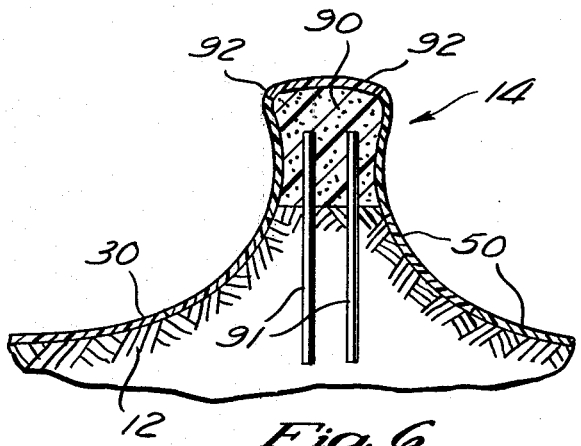
Fig. 6
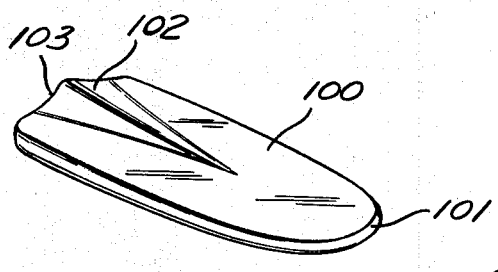
Fig. 7
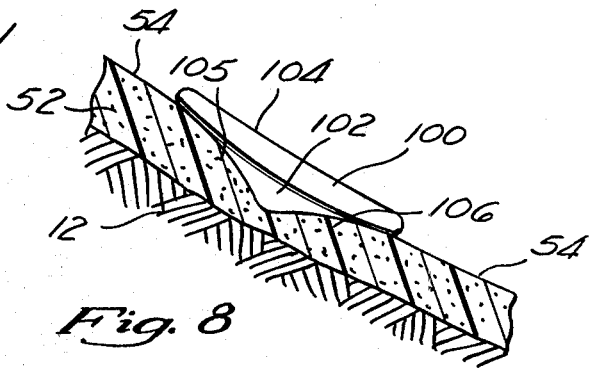
Fig. 8

SURFING SLIDE

BACKGROUND OF THE PRESENT INVENTION

The present invention relates to amusement apparatus, and more particularly to an aquatic amusement apparatus which simulates the natural ocean wave action encountered during body and board surfing.

In recent years, there has been a dramatic resurgence in the United States in the well-known sport of body and/or board surfing. Heretofore, the sport has been best practiced in only those few states, such as California, Florida, and Hawaii, which not only possess long coastlines, but tropical or semi-tropical climates yielding relatively warm water temperatures to permit surfing throughout the majority of the year.

Although attempts have been made to duplicate the natural wave conditions of ocean bodies at inland locations, such attempts have typically comprised artificial wave making apparatus, wherein a large, man-made body of water is provided with suitable mechanical means to generate a water wave form. Although such prior art artificial wave generating apparatus have permitted body and board surfing in inland areas, there are substantial deficiencies associated in their use.

Foremost of these deficiencies is the extreme high cost incurred in their initial installation and subsequent operation and maintenance. As will be recognized, the construction of a man-made water reservoir and complex hydraulic/mechanical wave generating system requires substantial capital expenditure. Further, the constant chemical treatment of the water and maintenance of the hydraulic/mechanical system yield a significant financial obstacle which has made the widespread use of such prior art apparatus cost prohibitive.

Additionally, due to the prior art's use of a large body of water and hard concrete reservoir bottom, such devices continuously pose a significant safety hazard to the user requiring constant monitoring of the apparatus by professional lifeguards. These safety hazards become acute when the apparatus is congested with novice users with surfboards often kicking out of the wave form and impinging upon other swimmers and surfers in the water. Further, such prior art apparatus have been severely limited as to site location, typically requiring relatively warm climate environments so that the water reservoir need not be heated throughout the major portion of the year.

Although a few devices have recently been introduced to permit body planing, skiing, or tobogganing on an artificial surface, as disclosed in Carrier (U.S. Pat. No. 2,982,547) and Wehr et al (U.S. Pat. No. 3,091,998), such devices have failed to provide any means for simulating ocean wave action.

Thus, there exists a substantial need for a relatively low-cost amusement apparatus, simulative of natural ocean wave action, which may be located at inland locations and efficiently operated without posing a significant safety hazard to the user.

SUMMARY OF THE PRESENT INVENTION

The present invention comprises an aquatic amusement apparatus which simulates the riding experience encountered in ocean surfing while eliminating the substantial cost, site location, and safety hazards associated with the prior art wave generating apparatus.

Particularly, the present invention comprises a shaped slope having a plurality of stationary wave-like contours and surface irregularities, which is covered with a vinyl-coated foam substrate. The foam substrate incorporates an irrigation system to distribute a thin film of water over its smooth upper vinyl surface which reduces friction to enable a user to rapidly travel down the slope on either his body, an inntertube or a surfboard-like vehicle. Due to the slightly deformable, resilient nature of the foam substrate, a user is able to turn and maneuver as he travels down the slide by shifting his weight on the surfboard-like vehicle thereby obtaining a bite from the deformation of the foam. Further, by banking off the stationary wave-like contours of the apparatus, a user may selectively increase or stall his speed on the apparatus, and cut back transversely across the slope.

In the preferred embodiment, the vinyl coated foam substrate is supplied in prefabricated elongate panel sections each including vinyl extensions along their edges which permit adjacent panels to be abutted and cemented together to form a contiguous covering for the slope. Additionally, each of the prefabricated panel sections is provided with one or more primary irrigation tubes along its length, which include a plurality of fittings adapted to accept plural irrigation leads extending upward through the foam substrate and terminating at the upper surface of the panel sections. The primary irrigation tubes of each of the panel sections may be interconnected to a common recirculating water supply to distribute a thin film of water through the distribution tubes and onto the top surface of the entire slope.

Due to the relatively thick foam substrate covering the entire apparatus, a user, accidentally falling from his surfboard-like vehicle, may simply slide down the slope on his body without injuring himself. Additionally, due to the apparatus functioning as a wave action simulator without the use of large quantities of water, the present invention may be installed at substantially all inland locations and efficiently operated throughout the majority of the year.

DESCRIPTION OF THE DRAWINGS

These, as well as other features of the present invention, will become more apparent upon reference to the drawings wherein:

FIG. 4 is an enlarged perspective view of a first embodiment of a central irrigation system provided in each of the panel sections;

FIG. 5 is an enlarged cross-sectional view, taken about lines 5—5 of FIG. 4, showing the preferred orientation of the irrigation lead lines which extend from the undersurface of the panel sections to the top surface thereof;

FIG. 5 is a perspective view of one of the stationary wave-like contours formed on the surfing slide apparatus of the present invention;

FIG. 7 is a perspective view of a surfboard-like vehicle which may be utilized on the apparatus of the present invention; and FIG. 8 is a cross-sectional view of one of the panels of the present invention illustrating the manner in which the vehicle of FIG. 7 permits maneuverability during travel down the apparatus.

DETAILED DESCRIPTION OF THE PREFERRED EMBODIMENT

Figure 1:
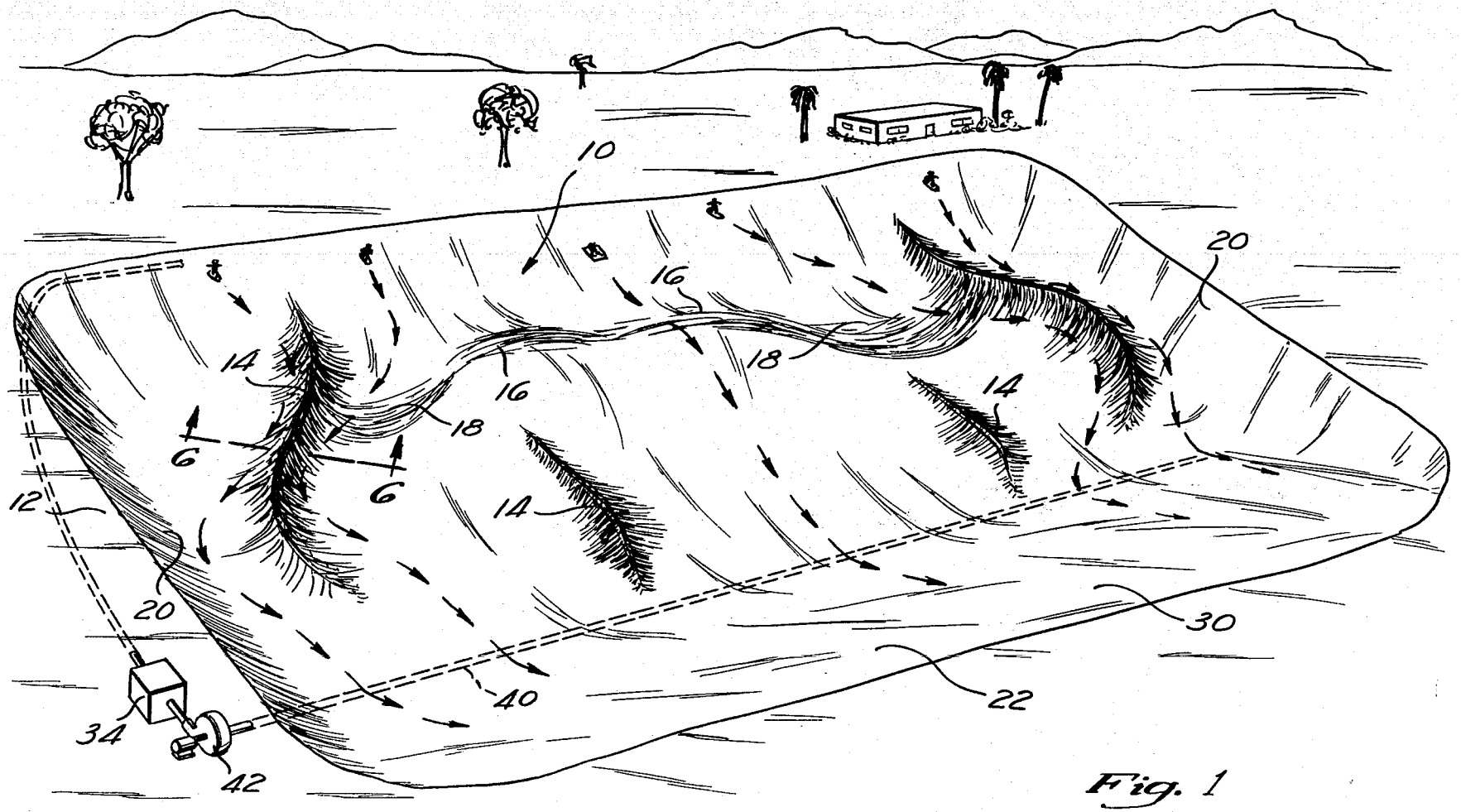
FIG. 1 is a perspective view of the surfing slide apparatus 10 of the present invention, illustrating a preferred shaped slope configuration, and depicting the irrigation recirculation system.

Referring to FIG. 1, there is shown the surfing slope apparatus 10 of the present invention. The apparatus 10 may be formed in any desired size and configuration and the specific configuration illustrated in FIG. 1 is disclosed merely as by way of example. The surfing slope apparatus 10 is formed on an excavated or shaped slope 12, having a preferred downward inclination of approximately 7 to 20 degrees. The excavation 12 includes a plurality of stationary wave-like contours 14 jutting vertically upward from its main planar slope as well as various rises 16 and depressions 18 which form a generally smooth but irregular slope surface. The side walls 20 of the excavation 12 are preferably disposed in a substantially vertical orientation whereas the frontal portion 22 is disposed at a slight upward inclination. By such a configuration, a user is prevented from traveling off the apparatus 10 adjacent the side walls 20 and is gradually decelerated upon entry onto the frontal portion 22.

Figure 2:
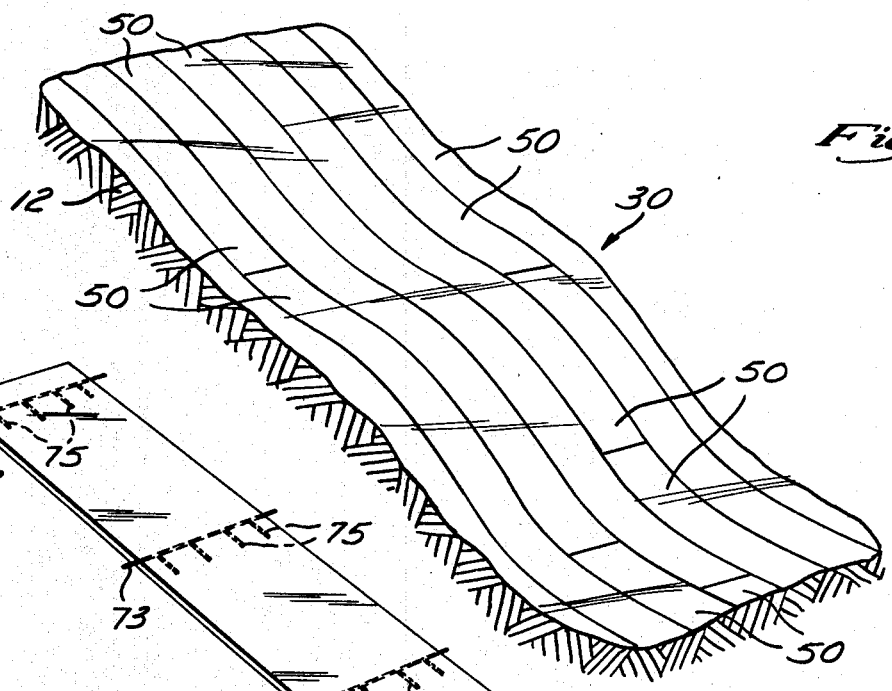
FIG. 2 is an enlarged perspective view of a portion of the surfing slide of FIG. 1 illustrating the brick-like lattice orientation of multiple panel sections thereon.
Figure 3A:
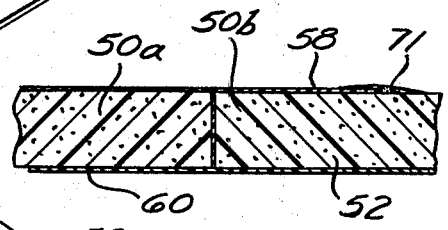
FIG. 3A is an enlarged cross-sectional view taken about lines 3A—3A of FIG. 3 showing the preferred manner in which the attachment panels of individual panel sections are secured to the planing surface of an adjacent panel section.
Figure 3:
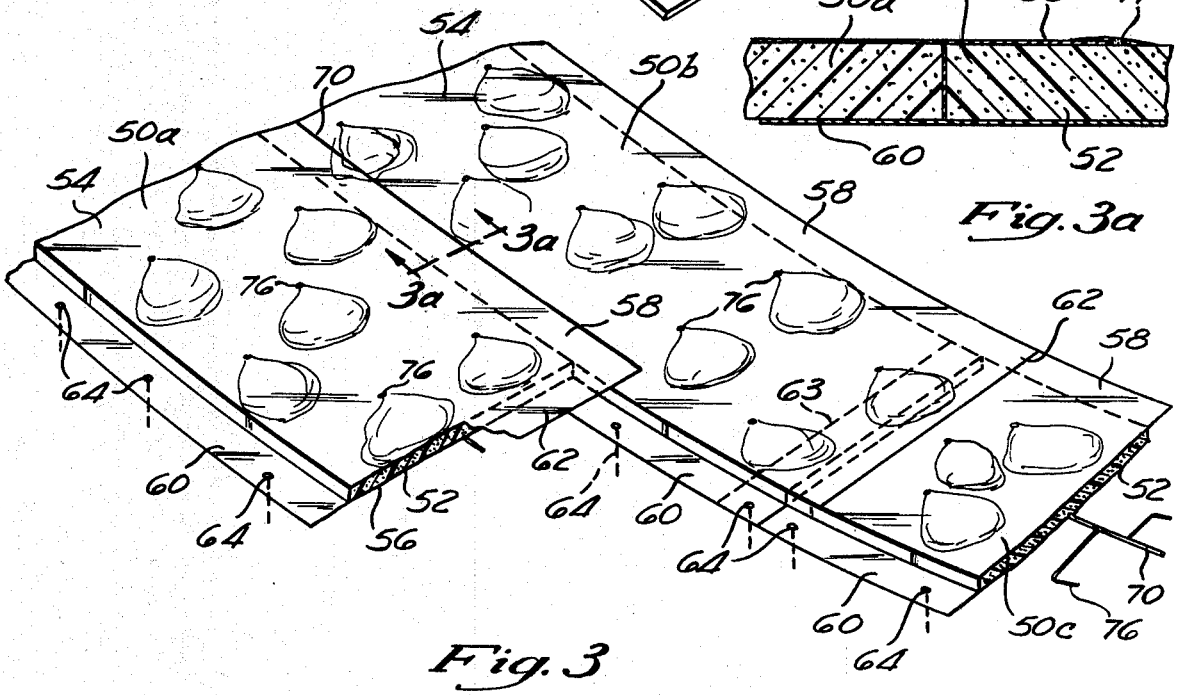
FIG. 3 is an enlarged perspective view of a portion of two elongate panel sections showing the preferred method of attaching adjacent panel sections together upon the excavation.

The entire excavation 12 is covered with a vinyl coated resilient substrate 30 which is rigidly attached and readily conforms itself to the contours of the excavation 12. The resilient substrate 30 is preferably formed from a plurality of prefabricated elongate panel sections 50 which are abutted in an end-for-end and side-by-side orientation upon the excavation 12 to form a contiguous surface covering. As best shown in FIGS. 2 and 3, each of the panel sections 50 is fabricated having a resilient core 52 formed of a urethane foam or foam rubber material, having upper and lower vinyl sheets 54 and 56, respectively, rigidly attached to its opposite planar surfaces. In the preferred embodiment, the panel sections 50 are sized to be approximately 54 inches wide and 100 feet in length, having a core thickness of approximately 1 inch.

Both the upper and lower vinyl sheets 54 and 56 extend a short distance outboard on opposite side edges of the foam core 52 forming upper and lower side attachment panels 58 and 60, respectively. Additionally, the upper vinyl sheet 54 extends a short distance beyond the frontal edge of the foam core 52 forming a front attachment panel 62, whereas the lower vinyl sheet forms a corresponding rear attachment panel 63.

The preferred method and procedure for installing the panel sections 50 upon the excavation 12 is illustrated in FIG. 3. As shown, a first panel section **50*a* (FIG. 3) is layed upon the excavation 12 and oriented such that its length dimension extends downward in the general direction of the excavation or shaped slope 12. The panel section 50*a* is subsequently attached to the excavation 12 by a plurality of metallic or plastic spikes 64 which are driven through the lower side attachment panel 60 and rear attachment panel (not shown) extending into the excavation 12 at spaced intervals along the length of the panel section 50*a*. With the first panel 50*a* located upon the excavation, a second panel section 50*b* may be juxtapositioned and registered with the first panel section 50*a* such that adjacent side edges of the foam core 52 of each of the panel sections 50*a* and 50*b* are abutted together. In this abutted orientation, the lower side attachment panel 60 of the panel section 50*b* is positioned to lie beneath a portion of the panel section 50*b*whereas the upper side attachment panel 58 of the panel 50*a* overlays a portion of the panel section 50*b***.

Aligned in such a manner, the upper side attachment panel 58 and adjacent edge portion of the panel section **50*a* may be rolled back, off the surface of the excavation 12 to expose the lower side attachment panel 60 of the panel section 50*b*. Additional spikes 64 may then be driven through the lower side attachment panel 60 and rear attachment panel (not shown) of the panel section 50*b* and into the excavation 12. A suitable cement or vinyl adhesive (not shown) may then be applied to the upper surface of the lower side attachment panel 60 of the panel section 50*b* as well as the lower surface of the upper side attachment panel 58 of the panel section 50*a*. Subsequently, the previously rolled back portion of the panel section 50*a* may be released and tightly pressed upon the panel section 50*b* wherein the adhesive interface securely joins the panel sections 50*a* and 50*b* together. A thin layer of vinyl coating 71 (shown in FIG. 3A) may then be applied to the exposed edge of the upper side attachment panel 58 of the panel section 50*a* to yield a relatively seamless surface transition between the adjacent panel sections 50*a* and 50*b***.

In a similar manner, opposite ends of each of the elongate panel sections 50 may be joined with an additional panel section by use of the frontal and rear attachment panels 62 and 63, respectively. As shown in FIG. 3, the additional panel section **50*c* is juxtapositioned at one end of the panel section 50*b* such that their foam cores 52 lie in an aligned abutted relationship. The frontal attachment panel 62 and end portion of the panel section 50*b* may be rolled off the surface of the excavation 12 exposing the rear attachment panel 63 of the panel section 50*c*. Additional spikes 64 may then be driven through the rear and side attachment panels 63 and 60 of the panel section 50*c* thereby anchoring the panel 50*c* to the excavation 12. Subsequently, a suitable adhesive may be applied to the upper surface of the rear attachment panel 63 of the panel section 50*c* and under surface of the frontal attachment panel 62 of the panel section 50*b* with the panel sections 50*b* and 50*c* being pressed tightly upon each other to form a secure juncture. As previously described, a thin vinyl layer 71 (FIG. 3A) may then be applied over the exposed edge of the frontal attachment panel 62 to form a substantially seamless surface transition joint between the panels 50*b* and 50*c***.

As may be recognized, by such a procedure, multiple panel sections 50 may be anchored to the slope and secured to adjacent panel sections on both sides and opposite ends to form a contiguous vinyl-coated foam covering for the entire surface of the excavation 12. Additionally, as shown in FIGS. 2 and 3, the ends of panel sections 50 in adjacent rows are preferably staggered or offset upon the slope excavation 12 to form a brick-like lattice construction. By such an offset staggered arrangement, the discontinuities formed at the abutment of the foam cores 52 of adjacent panel sections 50 are distributed over the entire surface of the apparatus 10 rather than being concentrated along a single line, so that the strength of the vinyl foam covering 30 is maintained through prolonged use.

In the preferred embodiment, the contiguous resilient substrate 30 formed by the interconnected panel sections 50 is provided with a water irrigation system which distributes a thin film of water over the upper vinyl surface of the apparatus to reduce surface friction and yield a slipprier planing surface. Referring to FIGS. 4 and 5, the detailed construction of a first embodiment this water irrigation system may be described.

As shown in the first embodiment of the irrigation system, each of the panel sections 50 includes a groove or recess 70 positioned along its lower surface which extends centrally throughout its length. The groove 70 is sized to loosely receive a length of flexible plastic tubing 72 including a plurality of standard "T" fittings 74 paced at intervals along its length. The tubing length 72 is typically formed of polyvinyl chloride material and is rigidly affixed and maintained within the recess 70 as by way of an adhesive during manufacturing of the prefabricated panel sections 50.

Each of the pipe fittings 74 is sized to accept one end of a flexible distribution tube 76 which may be formed in varying lengths to extend laterally outward from the central tubing length 72 to selected areas of the panel section 50. The opposite end of each of the distribution tubes 76 may be inserted through an aperture 80 formed in the panel section 50 and maintained therein by the application of a suitable adhesive within the aperture 80. As will be recognized the aperture 80 may be manually formed during the installation of the panel section 50 upon the excavation 12 or alternatively prefabricated into the panel section 50 during manufacture.

As shown in FIG. 5, the apertures 80 are preferably formed to extend angularly through the panel sections 50 and be oriented to face downward upon the slope. The upper end of the distribution tubes 76 are cut along a bias to be flush mounted with the top vinyl sheet 54 of the panel sections 50 and may be subsequently sealed to the top vinyl sheet 54 by the application of a vinyl coating about its outside diameter. By such an arrangement, it will be recognized that the flexible distribution tubes 76 may deform within the urethane core 52 of each of the panel sections 50 without tearing loose from the upper vinyl sheets 54. Additionally, due to the bias/-cut flush mounting with the vinyl sheet 54, a user may harmlessly slide over their exposed opened ends while traveling down the apparatus 10.

Each of the central tubing lengths 72 of the panel sections 50 is interconnected to form a composite irrigation system by means of suitable couplings (not shown) which are positioned during the previously described installation process of the individual panel sections 50 upon the excavation 12. The composite irrigation system is connected as by way of a manifold (not shown) to a water supply introduced at the upper-most elevation of the apparatus 10 such that gravity aids in the flow of water through the irrigation system, releasing small quantities of water through each of the open ends of the distribution tubes 76.

As shown in FIG. 1, a drain line or collector 40 is preferably provided at the lower-most elevation of the excavation 12 which receives the water flowing down the slope surface of the apparatus 10. The drain line 40 may be connected in series with a pump 42 and suitable filtering unit 34 to recirculate the water back to the manifold (not shown) at the upper-most elevation of the apparatus wherein the water may again travel through the composite irrigation system. As will be recognized, the irrigation system thus applies a continuous thin film of water to the upper vinyl sheets 54 of the panel sections 50 as depicted in FIG. 3.

Figure 4A:
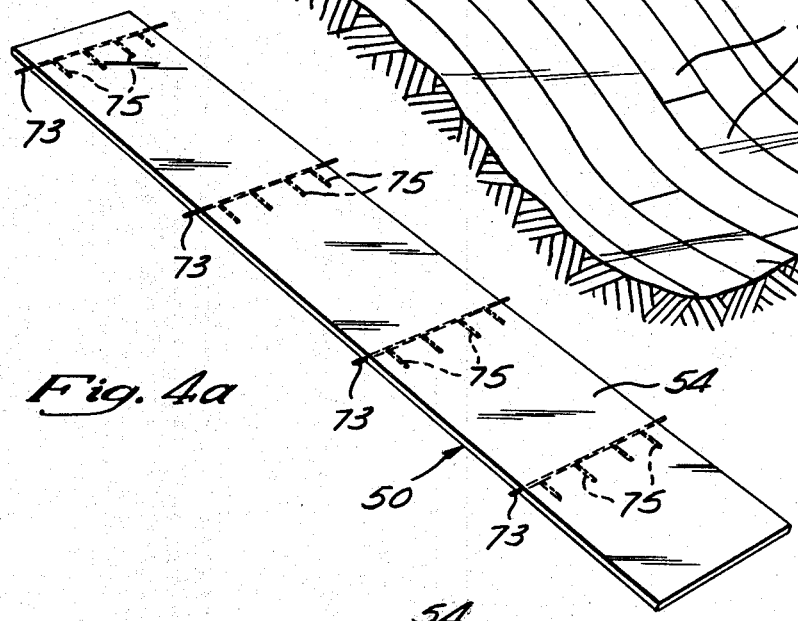
FIG. 4A is an enlarged perspective view of a second embodiment of the central irrigation system provided in each of the panel sections.

In those instances where the general downward inclination of the apparatus is great, it may be necessary to use a second embodiment irrigation system which reduces any pressure gradient within the irrigation system between the upper and lower portions of the apparatus. The construction of this second embodiment is depicted in FIG. 4A wherein instead of the central tubing 72, each of the panel sections 50 includes plural primary tubing sections 73 which are spaced along the length thereof and extend laterally across the width of the panel sections 50. Each of the primary tube sections 73 is provided with a plurality of distribution tubes 75 which as with the distribution tubes 75 of FIGS. 4 and 5 preferably are attached to the primary tube sections 71 by way of a T connection and extended angularly through panel sections 50 being bias cut at their upper end to be flush mounted with the top vinyl sheet 54.

Each of the primary tubing sections 71 of the panel sections 50 may be interconnected by way of a coupling (not shown) to a corresponding tubing section of an adjacent panel section 50 to form a composite irrigation system during the previously described installation process of the individual panel sections 50 upon the excavation 12. Once interconnected upon the excavation, each of the primary sections 73 may be connected to a suitable manifold (not shown) extending throughout the length and on one side of the apparatus which is connected to a suitable water supply. Further, the manifold may include conventional pressure regulation means to ensure that constant pressure is applied to each of the interconnected primary tube sections 73 along the length of the apparatus.

In FIG. 6, the detailed construction of one of the stationary wave-like contours 14 of the present invention is depicted. The excavation 12 in the vicinity of the wave-like contour 14 is formed to protrude vertically upward having a substantially convex outer surface configuration. The upper portion 90 of the wave-like contours 14 is typically formed having a tooth-like cross-sectional configuration such that opposite sides of the wave form 14 both approximate the crest of a wave. Although the upper portion 90 of the wave form 14 may be formed of earth fill, it is preferable to fabricate the portion 90 from either concrete which is poured in place upon the excavation 12, or rigid urethane foam which may be prefabricated and positioned upon the excavation 12. In either instance, the upper portion 90 may be anchored to the excavation by plural support rods 91 extending a substantial distance into both the upper portions 90 and excavation 12.

The entire wave form 14 is covered with one or more resilient vinyl panel sections 50 in a manner previously described and interconnected to adjacent panel section 50 to form a contiguous surface covering. The particular configuration of the wave form 14 may be varied to provide differing shaped wave contours, however, it is preferable that the upper-most surfaces 92 of the upper portion 90 extend outwardly from the center line of the wave form 14 so that a user is prevented from passing over the wave form 14 during travel down the apparatus 10.

Although the present invention is designed to permit a user to plane down the apparatus on his body, tire innertube or a mat, typically a board vehicle 100, specifically adapted for use upon the apparatus 10, will be utilized by a user to simulate ocean wave board surfing. As shown in FIG. 7, the board vehicle 100, preferably fabricated of a fiberglass, a semi-rigid polymer, or vinyl-coated rigid urethane substrate, is formed having a generally surfboard-like configuration including a wedge-shaped rudder member 102 formed along its lower surface. (Note that in FIG. 7 the board vehicle 100 is shown in an inverted orientation for purposes of illustration.) The rudder member 102 is preferably tapered, initiating at a distance spaced from the front end 101 of the board 100 and increasing in height as well as width dimensions as it approaches the board's rear end 103. The lower surface of the board may be formed in a generally planar configuration or alternatively with a slight convexity to augment maneuverability upon the apparatus 10.

With the structure defined, the operation and specific manner in which the apparatus 10 of the present invention simulates natural ocean wave surfing conditions may be described. As shown in FIG. 1, a user may stand or kneel upon the board vehicle 100 and embark upon the apparatus at its upper-most elevation. Due to the thin film of water distributed over the upper vinyl sheets 54 of the panel sections 50 and the downward inclination of the excavation 12, the user accelerates as he travels generally downward upon the apparatus 10.

The speed of travel on the apparatus may be controlled by the user selectively positioning his body weight upon either the frontal portion of the board vehicle 100, wherein the smooth concave lower surface of the board vehicle may freely plane across the thin film of water, or alternatively upon the rear portion of the vehicle 100, wherein the rudder member 102 is forced downward thereby deforming the foam cores 52 of the panel sections 50 and displacing the water film to increase frictional drag.

Maneuverability is additionally provided by the user shifting his weight upon the board vehicle 100 causing the rudder member 102 to selectively deform the foam core 52 of the panel sections 50. As shown in FIG. 8, by shifting body weight laterally upon the board vehicle 100, a user may depress the portion 106 of the foam core 52 lying on one side of the rudder section 102 causing the portion 105 of the foam core 50 lying on the other side of the rudder section 102 to raise vertically upward due to the internal resiliency of the foam material. By this depression and corresponding raising of the foam portions 105 and 106, the planing friction developed between the board vehicle 100 and the core 52 is selectively increased which causes the board vehicle 100 to be urged in the path of least resistance. As such, the frictional forces permit a user to obtain a "bite" from the foam core 52, thereby generating user-selected directional changes upon the apparatus.

As will be recognized, the resilient vinyl surface covering 30 of the apparatus deforms (i.e., reacts) in a proportional manner to the shifting of weight upon the board 100, with the greater foam depression 106 generating greater frictional drag and permitting greater direction changes. As such, a user may traverse down the apparatus, banking off the wave-like contours 14 to selectively increase and decrease speed and shifting his body weight upon the board vehicle 100 to obtain a "bite" from the foam core to cut back and stall during travel down the apparatus. Thus, board surfing can be effectively simulated on the apparatus 10.

In the preferred embodiment, the apparatus 10 is formed to provide a plurality of discrete paths of travel down the slope, indicated by the arrows in FIG. 1. By proper excavation, shaping or construction, each of the paths may be calibrated to provide varying levels of skill and speed thereby accommodating both novice and experienced users. In addition, a children's path may be provided which extends substantially straight down the slope without encountering any wave forms 14 or large surface irregularities.

Although in the preferred embodiment, it is contemplated that the surfboard-like vehicle 100 (as shown in FIG. 8) will be utilized upon the apparatus 10, it is within the scope of the present invention that other similar board structures, such as sleds or mats, may be utilized without departing from the spirit of the present invention. Additionally, due to the thin layer of water flowing down the apparatus 10, as well as the soft resilient foam core 52 of the individual panel sections 50, users falling off the vehicle apparatus may travel harmlessly down the slope, safely decelerating when they reach the frontal portion 22 of the apparatus.

As such, it will be recognized that the present invention provides a relatively low cost aquatic amusement apparatus which simulates the natural wave action encountered during surfing while eliminating the substantial safety and site location deficiencies heretofore associated in prior art wave simulating apparatus.

I claim:

1. An amusement apparatus for simulating riding motion over an ocean wave as encountered in ocean surfing, comprising:

a shaped slope having a generally downward inclination to provide a desired rate of descent;

a plurality of prefabricated panel sections positioned on said slope forming a relatively seamless covering with a smooth surface finish on which a user may slidably travel, said panel sections adapted to deform to direct a user's path in response to forces exerted against them by said user in sliding travel, each of said sections comprising:

an upper and a lower thin surface sheet, said upper sheet having a smooth surface finish to provide a slippery surface when wet;

a resilient core disposed between said surface sheets;

means for interconnecting said panel sections to provide a relatively seamless upper smooth surface including means for anchoring said panel sections to said slope; and means for applying a thin film of water upward through openings distributed throughout the upper surface to the smooth surface of said upper sheet in continuum.

2. The amusement apparatus of claim 1 wherein said interconnecting means comprises:

an extended portion of said upper surface sheet extending outwardly along the peripheral edges of said core; and an extended portion of said lower surface sheet extending outwardly along the peripheral edges of said core, each of said panel sections positioned adjacent to and along an edge of another panel section with said upper and lower surface sheet extended portions overlaying and underlaying the respective upper and lower surfaces of adjacent panel sections and bonded thereto.

3. The amusement apparatus of claim 2 wherein said upper extended portion of the surface sheet extends from two edges of said panel section, and said lower extended portion extends from two edges of said panel section.

4. The amusement apparatus of claim 1 wherein said water applying means is included within each prefabricated panel section positioned beneath and extending through said upper surface sheet to flexibly cooperate with said resilient core to yield when said panel section is deformed by a user sliding thereon.

5. The amusement apparatus of claim 1 wherein said resilient core is enclosed within said upper and lower surface sheets.

6. The amusement apparatus of claim 1 wherein said resilient core is affixed to said upper and lower surface sheets.

7. The amusement apparatus of claim 1 further comprising one or more raised wave-like contours formed on said shaped slope, having a generally concave outer surface configuration and adapted to permit a user to bank there against during sliding travel down said slope.

8. The amusement apparatus of claim 7 with each wavelike contour comprising: a formed support having substantially concave lateral surface;

means for anchoring said support;

a plurality of said panel sections covering said contoured surface and affixed thereto, to form an uninterrupted surface covering with a smooth surface; and said water applying means applying a thin film of water to the smooth surface of said panel sections in continuum.

9. The amusement apparatus of claim 7 wherein said wavelike contours are positioned to form a curvlinear path having a generally downward inclination.

10. An amusement apparatus for simulating riding motion over a wave as encountered in ocean surfing comprising:

a shaped slope having a generally downward inclination to provide a desired rate of descent;

a plurality of prefabricated panel sections positioned on said slope and interconnected to form a relatively seamless smooth surface covering having a slippery surface when wet, said panel sections being adapted to deform in response to a user's sliding travel thereover to direct a user's path; and a means for applying a thin film of water to the surface of said smooth covering in continuum, a section of said water applying means being positioned in each of said prefabricated panel sections and comprising:

at least one fluid conduit positioned in and extending through said panel section;

one or more distribution tubes positioned within said panel section, having one end connected to said conduit and a second opposite end opening through and to said smooth surface of the panel section; and coupling means for interconnecting said fluid conduits to adjacent ones of each of said panel sections; and means for supplying water to said interconnected fluid conduits.

11. The apparatus of claim 1 or 10 wherein said shaped slope includes plural surface irregularities to selectively increase and decrease the descent of said user upon said slope.

12. The apparatus of claim 1 or 10 wherein said shaped slope includes a frontal portion adjacent its lower-most elevation having a slight upward inclination to gradually decelerate a user after travel down said slope.

13. The apparatus of claim 6 wherein said second end of the distribution tube opening to said smooth surface extends angularly through said panel section from said conduit forming an acute angle with said surface to flexibly cooperate with said panel section when it is deformed.

14. The apparatus of claim 10 wherein said second end of the distribution tube is bonded to said smooth surface in a flush manner.

15. The apparatus of claim 10 wherein said water applying means additionally comprises:

means for supplying and recirculating water through said conduits and distribution tubes when said panel sections are interconnected.

16. The apparatus of claim 1 or 10 further comprising a vehicle adapted to be ridden by a user on said covering, said vehicle cooperating with said covering to permit a user to maneuver during travel down said slope.

17. The apparatus of claim 16 wherein said vehicle comprises an elongate member, including rudder means on one surface thereof for selectively deforming said covering in response to the shifting of a user's body weight on said elongate member.

18. The apparatus of claim 17 wherein said rudder means comprises a wedge-shaped protrusion on said one surface of said elongate member initiating at a distance spaced from one end of said elongate member and increasing in height and width toward the opposite end of said elongate member.

* * * * *